US005085229A

United States Patent [19]

Tallier et al.

[11] Patent Number: 5,085,229

[45] Date of Patent: Feb. 4, 1992

[54] METHOD AND APPARATUS FOR FORMING CONTINUOUS CIGARETTE RODS

[75] Inventors: Bernard Tallier, Gorgier; Michael Lauenstein, Cormondrèche, both of Switzerland

[73] Assignee: Fabriques de Tabac Reunies, S.A., Neuchatel, Switzerland

[21] Appl. No.: 525,702

[22] Filed: May 21, 1990

[30] Foreign Application Priority Data

May 25, 1989 [CH] Switzerland ..... 2012/89

[51] Int. Cl.[5] ..... A21C 5/18

[52] U.S. Cl. ..... 131/84.4; 131/84.3; 131/906

[58] Field of Search ..... 131/84.1, 84.2, 84.3, 131/84.4, 906

[56] References Cited

U.S. PATENT DOCUMENTS 4,036,238 7/1977 Okumoto .
4,284,087 8/1981 Reuland .
4,875,494 10/1989 Siems .

FOREIGN PATENT DOCUMENTS 3705576 9/1988 Fed. Rep. of Germany .
2299822 9/1976 France .
2028097 3/1980 United Kingdom .
2196524 5/1988 United Kingdom .
2207594 2/1989 United Kingdom .
2207595 2/1989 United Kingdom .

*Primary Examiner*—V. Millin
*Attorney, Agent, or Firm*—Jeffrey H. Ingerman

[57] ABSTRACT

A layer of tobacco (5) is accumulated against a conveyor belt (2) by a flow of air (6). A trimmer (7) eliminates the superfluous tobacco and forms the final layer (10) which is to be wrapped in paper to form the cigarette rod. One measuring unit (13) measures the thickness of the layer by means of the attenuation of a ray, while another measuring unit (14) measures the degree of porosity of the layer by means of the drop in air pressure between the bottom and the top of the layer. These two data are transmitted to an arithmetic unit (19) which forms a parameter (F), transmitted to a central processing unit (17) which supplies to a transducer (16) the pulses actuating an encoder (15) of a motor (11) governing the thickness of the final layer.

13 Claims, 4 Drawing Sheets

METHOD AND APPARATUS FOR FORMING CONTINUOUS CIGARETTE RODS

This invention relates to the manufacture of cigarettes, and more particularly to a method for forming a continuous rod in cigarette manufacture, of the type comprising the suction of a flow of air carrying along particles of tobacco, to form a layer of tobacco applied against a conveyor belt, the trimming of this layer, and one or more measurement operations supplying one or more items of data which control the trimming operation. The invention further relates to apparatus for carrying out this method, of the type comprising a conveyor belt, air-flow suction means, capable of conveying a flow of tobacco particles with the aspirated air and of concentrating these particles in the form of a layer pressed against the conveyor belt, a trimming device, and a device for controlling the thickness of the layer.

For some time now, the checking methods used in the automatic mass-production of cigarettes have been the subject of improvements relating to the accuracy of the checking operations with the object of obtaining a finished product having characteristics and a quality which can be guaranteed with total continuity within increasingly precise limits.

Thus, it is sought to ensure that the density of the tobacco particles along the length of each cigarette and, consequently, the degree of compression of such particles have completely predetermined and constant values. On the other hand, in order to improve the quality of the product, provision is made for a slightly greater compression of the tobacco at the ends of each cigarette than in the middle portion in order to avoid the risk of leakage of the particles. Thus, for example, U.S. Patent application Ser. No. 389,180, also assigned to the present assignee, describes apparatus which combines the operations of trimming and of intermittent compression of the cigarette rod.

The density of the tobacco particles is not constant along the length of each cigarette. On the contrary, it follows a specific curve. However, it is sought to have this curve identical for all cigarettes. Moreover, it is sought to check as accurately as possible the degree of humidity and the other characteristics of the tobacco particles.

An electronic checking system has recently been developed by means of which numerous data can be processed statistically. For example, this apparatus is capable of detecting the rate of filling of the tobacco particles twenty-four times along the length of each cigarette and of recording and displaying the data thus collected. It makes it possible to eliminate automatically the cigarettes deemed defective in production attaining rates of up to 5,000 or even 10,000 cigarettes per minute.

The trimmer is the apparatus which controls the rate of filling of the cigarette rod, so that the data collected during production must act upon that apparatus so as continuously to adjust its position.

Methods and apparatus for determining the density of the layer of tobacco in a vertical section of the flow, in front of the trimmer, have already been proposed. Determination of the density generally takes place by measuring the attenuation of a beam passing through the layer (see, for example, U.S. Pat. Nos. 4,284,087 and 4,036,238 and published U.K. Patent Application No. 2,207,595).

For avoiding phenomena of instability deriving from the fact that the layer of tobacco forming against the conveyor belt generally exhibits undulations, provision has also been made to check the action of the trimmer on the basis of height measurements made upstream and downstream from the apparatus.

Along these lines, published West German patent application No. 37 05576 discloses a method and apparatus providing for successive measurements of the attenuation of a beam of rays through the layer of tobacco at two locations respectively situated upstream and downstream from the trimmer. These measurements are processed in terms of a predetermined algorithm to form a signal which controls the trimmer.

It has been found, however, that this method of adjustment and the respective apparatus have drawbacks owing to the fact that the measurement of the attenuation of the intensity of a beam passing through the layer of tobacco is not a reliable item of data. Such attenuation may derive either from excessive thickness of the layer or from the fact that relatively large particles are packed against the belt. These two situations produce the same effect upon the measuring apparatus, which is therefore not able to distinguish between them.

It is an object of this invention to provide an improved method of measurement and respective apparatus in order to eliminate the confusion which has existed until now in prior art apparatus.

It has been found possible to make the necessary distinction by carrying out two different kinds of measurements and by suitably processing the signals representing the results of these measurements.

To this end, in the method according to the present invention, of the type initially mentioned, two measurement operations are continuously carried out before trimming, these measurements relating to the height of the layer and to its porosity, there is formed with the values resulting from these measurement operations, and by application of a predetermined algorithm, a parameter corresponding to the linear density of the layer of tobacco, and this parameter is used as a datum for controlling the trimming operation.

In the apparatus for carrying out the foregoing method according to the present invention, also of the type initially mentioned, the device for controlling the thickness of the layer comprises separate measurement means for the porosity and the height of the layer of tobacco, signal-processing means capable of producing a control parameter starting from measurement signals transmitted by the measurement means, and a means for adjusting the action of the trimmer, reacting to the instantaneous value of the parameter.

A preferred embodiment of the foregoing method and apparatus and a modification thereof will now be described in detail with reference to the accompanying drawings, in which.

Figure 1:
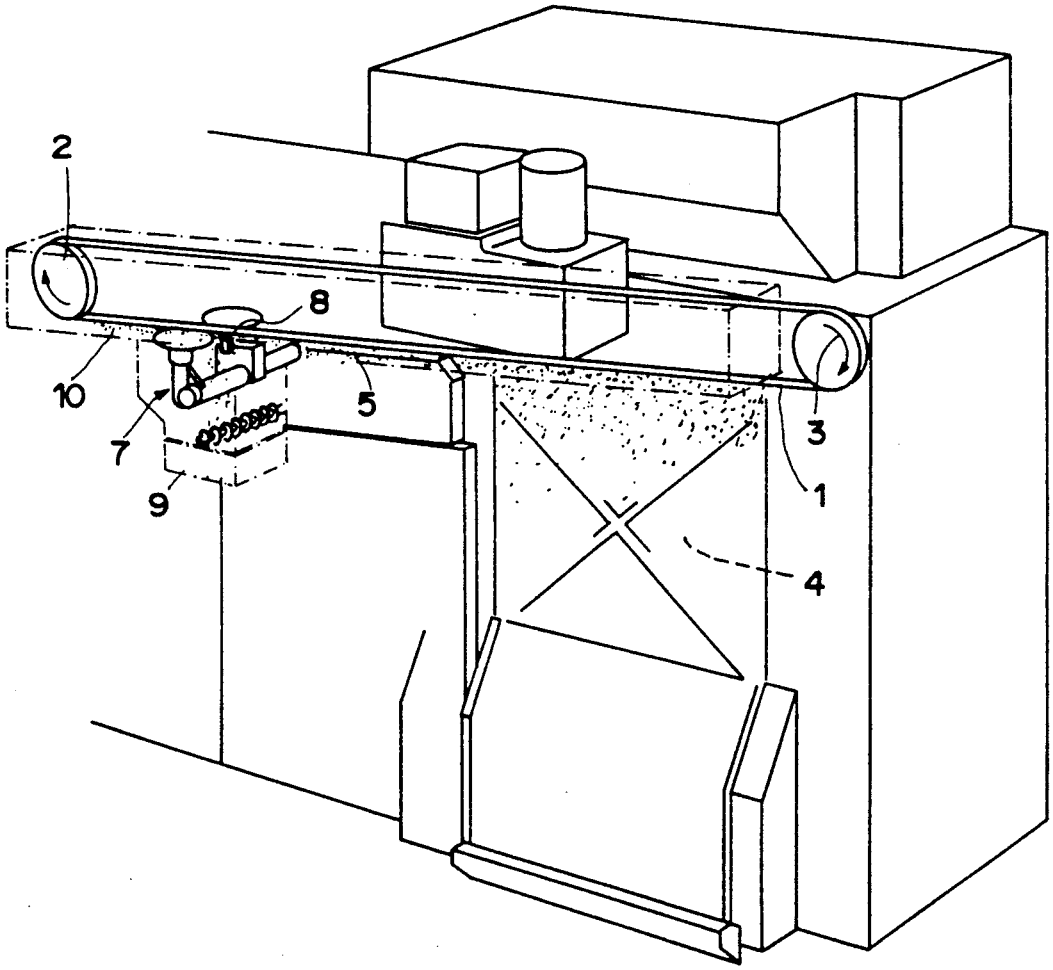
FIG. 1 is an overall perspective view of the cigarette rod-forming machine.
Figure 2:
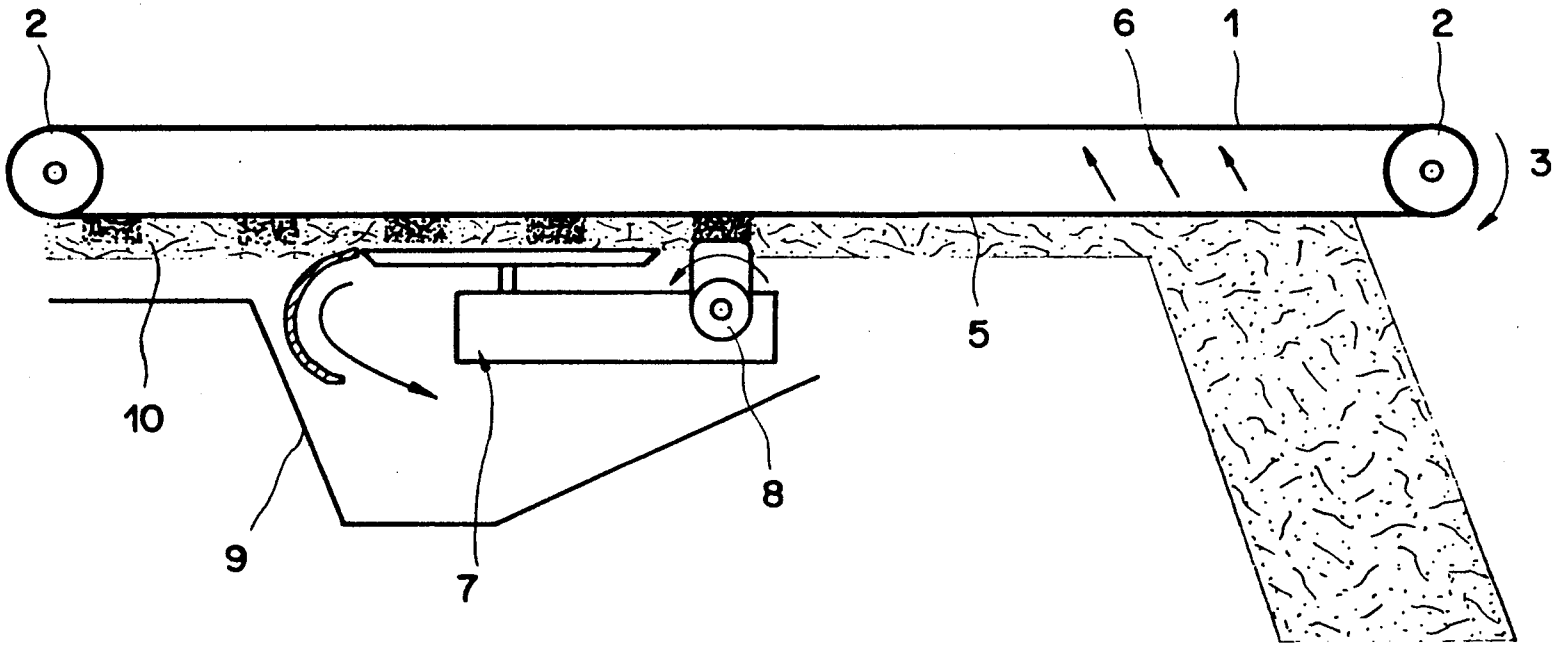
FIG. 2 is a diagrammatic elevation illustrating the main operations during formation of the cigarette rod.

The general principle of forming the cigarette rod is illustrated in FIG. 2. An endless conveyor belt 1, made of an air-permeable nylon material, is mounted on rollers 2 and moves in the direction indicated by arrow 3. A tobacco-supplying device 4 (FIG. 1) is placed under the right-hand end, as viewed in the drawings, of conveyor 1, 2. By means of a fan (not shown), a flow of air 6 is produced, which passes through both lengths of belt 1 and which conveys bulk tobacco particles from a storage bin in an upwardly slanting direction so that they accumulate under the lower length of belt 1 as a layer 5. The rate of compression and the thickness of layer 5 depend roughly upon the characteristics of the flow of air. The cigarette rod proper assumes its final structure owing to two devices which may, as previously mentioned, be combined and which are shown diagrammatically in FIG. 2 in the form of a trimmer 7 and an intermittent-compression cam 8. The tobacco particles separated by trimmer 7 drop into a trough 9 and are returned toward supply bin 4 by means not shown. Cigarette rod 10, which now has its final compression properties and cross-section, is conveyed downstream. It is wrapped in a continuous strip of paper which will subsequently be glued longitudinally, then cut into cigarettes.

Figure 3:
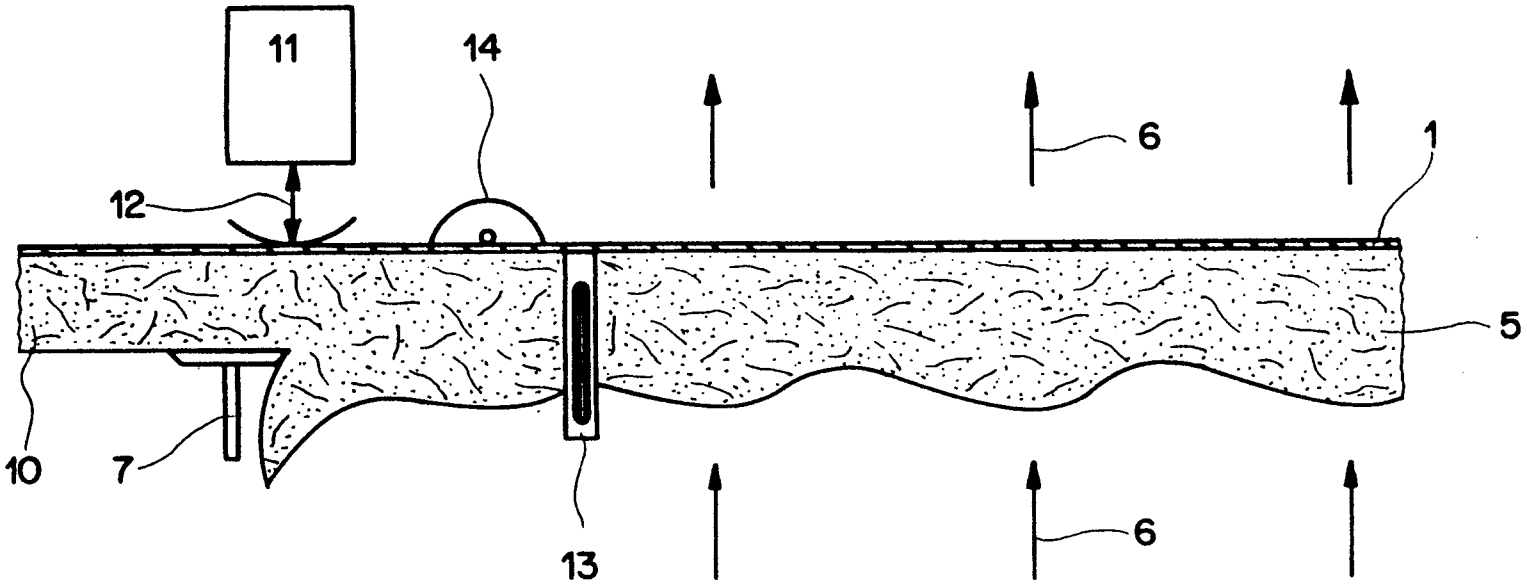
FIG. 3 is a diagrammatic longitudinal section showing the position of the sensors.

FIG. 3 shows in more detail, though still diagrammatically, the conditions for the formation of layer 5. Air flow 6 is generally at a pressure below atmospheric pressure since it is aspirated by a fan; but the pressure above belt 1 is lower than in the space beneath it, the drop in pressure depending on the fact that the tobacco particles accumulated against belt 1 form an obstacle to the passage of the air. It may also be seen from FIG. 3 that the thickness of the layer of tobacco 5 is irregular. As a result of instability phenomena which are difficult to monitor, waves are formed, which trimmer 7 has the task of evening out.

As concerns this latter apparatus, which is described in the U.S. patent application mentioned earlier, it is not necessary to give full details. Suffice it to say that the thickness of the layer of tobacco, in the downstream portion thereof designated by reference numeral 10, is determined by the height of a pair of rotary disks, driven by a motor and mounted on a support which may be either fixed or vertically movable. In the case illustrated in FIG. 2, the position of trimmer 7 is fixed. On the other hand, a DC servo-motor 11, placed above belt 1 opposite trimmer 7, can actuate a pusher rod 12 upward or downward to modify the position of belt 1 opposite trimmer 7, thus regulating the thickness of layer portion 10.

For carrying out the method defined above, two data detectors are provided upstream from trimmer 7 and thickness regulator 12, driven by motor 11. In this particular case, the detectors are made up of a laser-beam measuring device 13, which determines the instantaneous height of layer 5 at the location where it is placed, and of a pressure sensor 14, situated immediately downstream from height-measurement instrument 13, which is of a type known per se. This instrument can operate by means of a laser beam, measuring the attenuation of the intensity of the beam as it passes through layer 5. It may likewise be an instrument measuring the intensity of infrared radiation or of a flow of electrons, i.e., of beta radiation. This measuring instrument is capable of providing repeated indications, taken at intervals of from 0.5 to 12 ms, and of generating electronic signals corresponding to the measured values, so as to transmit them to the equipment for producing the control parameter.

Pressure sensor 14 measures the difference in pressure between the bottom zone and the top zone of layer 5 along a surface which is very small in the direction of travel of belt 1, whereas in the direction perpendicular to the plane of the drawing it covers the whole width of layer 5. It therefore measures the porosity of the tobacco accumulated in layer 5. Pressure sensor 14 may transmit signals giving the measurement values as intervals of from 0.5 to 12 ms, so that for an output on the order of 5,000/min. and a measuring-time constant of 5 ms, the equipment can transmit twenty-four measurement signals over the length of each cigarette. These signals are used to carry out two corrections on each cigarette.

Figure 4:
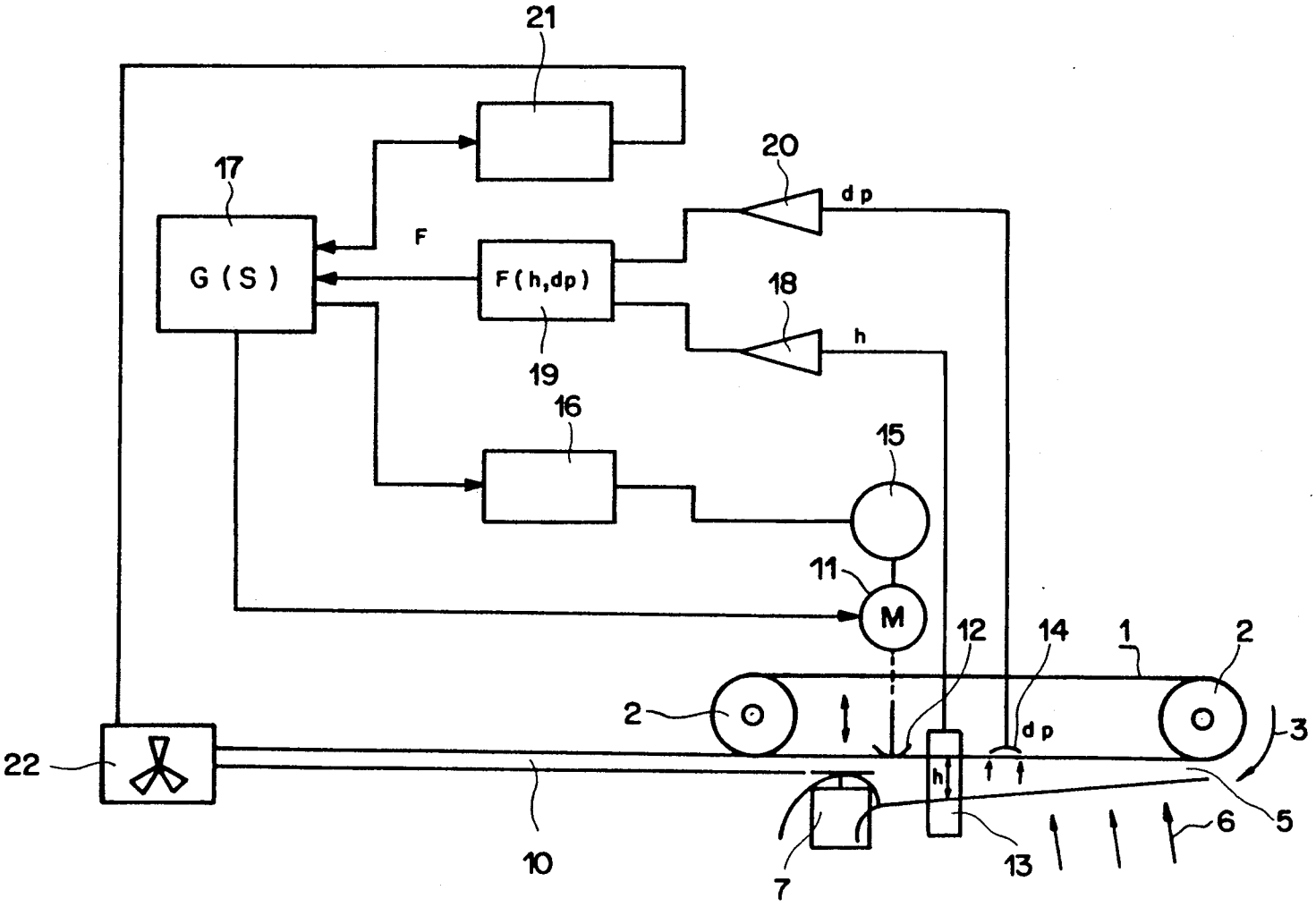
FIG. 4 is a diagram of the rod-forming equipment and the main elements of the system for processing the measurement signals.

FIG. 4 shows once more the main elements of the apparatus for forming the cigarette rod. Motor 11 is controlled by an encoder 15 which receives its commands from a positional transducer 16 connected to a central processing unit 17. The height-measurement signals transmitted by measuring device 13 are amplified by an amplifier 18 and transmitted to an arithmetic unit 19, which likewise receives from an amplifier 20 the pressure-measurement signals supplied by measuring element 14. By means of the data from amplifiers 18 and 20, arithmetic unit 19 executes a predetermined algorithm, supplying at its output a signal representing a parameter F which is transmitted to CPU 17. Based on the values of this parameter, the commands are calculated and transmitted by transducer 16 to encoder 15 and, consequently, by motor 11 to the linear actuator which controls the position of element 12.

As will likewise be seen in FIG. 4, a checking and statistical measurements unit 21 can receive the data necessary for its operation from CPU 17. It may also receive information from a radioactivity checking device 22 placed in the path of the cigarette rod and checking the cigarette rod as to possible nuclear-type emissions.

It is furthermore obvious that checking system 21 can also process other data detected downstream on the cigarette rod or upstream in bulk tobacco-particle bin 4.

There is thus produced an integrated measurement-checking and adjusting unit which is capable of operating with an extraordinarily rapid response-time constant, programmable at will.

What is claimed is:

1. Apparatus for forming a continuous rod in cigarette manufacture, comprising:

a conveyor belt;

air flow suction means capable of conveying a flow of tobacco particles with the aspirated air and of concentrating these particles in the form of a layer pressed against said conveyor belt; and means for controlling the thickness of said layer of tobacco comprising:

a trimmer, first measurement means before said trimmer for measuring the porosity of said layer of tobacco, second measurement means before said trimmer for measuring the height of said layer of tobacco, signal processing means capable of producing a control parameter starting from measurement signals transmitted by said first and second measurement means, and adjustment means reacting to the instantaneous value of said parameter for adjusting the action of said trimmer.

2. The apparatus of claim 1, wherein said first and second measurement means are disposed at adjoining locations situated upstream from said trimmer.

3. The apparatus of claim 2, wherein said second measurement means comprises a laser beam.

4. The apparatus of claim 2, wherein said first measurement means is arranged for measuring the drop in pressure of said air flow during passage thereof through said layer of tobacco over a surface portion of said layer.

5. The apparatus of claim 1, wherein said adjustment means is associated with said trimmer for moving said trimmer in a direction perpendicular to said conveyor belt.

6. The apparatus of claim 5, wherein said adjustment means comprise a pulse generator reacting to the value of said parameter and a DC motor associated with said pulse generator.

7. The apparatus of claim 1, wherein said adjustment means is associated with said conveyor belt for moving a portion of said conveyor belt situated opposite said trimmer in a direction perpendicular to said conveyor belt.

8. The apparatus of claim 7, wherein said adjustment means comprise a pulse generator reacting to the value of said parameter and a DC motor associated with said pulse generator.

9. A method of forming a continuous rod in cigarette manufacture, said method comprising the steps of providing a suction air flow for carrying along particles of tobacco to form a layer of tobacco applied against a conveyor belt, and trimming the layer of tobacco, wherein the improvement comprises the further steps of:

continuously measuring, before trimming, the height and the porosity of the layer of tobacco;

forming with the values resulting from the measuring step, and by application of a predetermined algorithm, a parameter corresponding to the linear density of the layer of tobacco; and controlling the trimming step by means of the formed parameter.

10. The method of claim 9, wherein the step of measuring the porosity of the layer of tobacco comprises measuring the drop in pressure of a portion of the air flow aspirated through the layer of tobacco during passage of the air flow through the layer of tobacco.

11. The method of claim 9, wherein the step of measuring the height of the layer of tobacco comprises measuring the attenuation of a beam of rays emitted through the layer of tobacco.

12. The method of claim 9, wherein the controlling step comprises monitoring movement of the trimmer to modify the thickness of the layer of tobacco evened by the trimmer.

13. The method of claim 9, wherein the controlling step comprises monitoring movement of the conveyor belt to modify the thickness of the layer of tobacco evened by the trimmer.

* * * * *

UNITED STATES PATENT AND TRADEMARK OFFICE

CERTIFICATE OF CORRECTION

PATENT NO. : 5,085,229

DATED : February 4, 1992

INVENTOR(S) : Bernard Tallier et al.

It is certified that error appears in the above-identified patent and that said Letters Patent is hereby corrected as shown below:

Column 4, line 10, "5" should be -- 0.5 --.

Signed and Sealed this

Fifteenth Day of March, 1994

*Attest:*

BRUCE LEHMAN

*Attesting Officer*

*Commissioner of Patents and Trademarks*